US006327948B1

(12) United States Patent
Tuori

(10) Patent No.: US 6,327,948 B1
(45) Date of Patent: Dec. 11, 2001

(54) METHOD AND APPARATUS FOR CUTTING THE EDGE OF A MOVING PAPER WEB

(76) Inventor: Esko Tuori, Turkimuspolku 8, FIN-39200 Kyroskoski (FI)

( * ) Notice: Subject to any disclaimer, the term of this patent is extended or adjusted under 35 U.S.C. 154(b) by 0 days.

(21) Appl. No.: 09/544,296

(22) Filed: Apr. 6, 2000

Related U.S. Application Data

(63) Continuation-in-part of application No. 09/043,653, filed on Mar. 25, 1998, now abandoned.

(51) Int. Cl.[7] ..... B26F 3/00
(52) U.S. Cl. ..... 83/53; 83/98; 83/177
(58) Field of Search ..... 83/53, 98, 100, 83/177, 402

(56) References Cited

U.S. PATENT DOCUMENTS

| | | | |
|---|---|---|---|
| 3,724,045 | 4/1973 | Dryon . | |
| 3,976,237 | 8/1976 | Bossons . | |
| 4,300,421 | 11/1981 | Yano et al. . | |
| 4,505,412 | 3/1985 | Reba . | |
| 4,527,346 | 7/1985 | Schwartzott . | |
| 4,542,842 | 9/1985 | Reba . | |
| 4,620,466 | 11/1986 | Jumel et al. . | |
| 4,747,329 | 5/1988 | Lukens, Jr. . | |
| 4,904,344 | 2/1990 | Peiffer . | |
| 4,931,140 | 6/1990 | Peltola et al. . | |
| 5,003,729 | 4/1991 | Sherby . | |
| 5,036,737 | 8/1991 | Glaser . | |
| 5,042,351 | 8/1991 | Rosenthal . | |
| 5,083,487 | 1/1992 | Croteau . | |
| 5,382,404 | 1/1995 | Kogame . | |
| 5,571,381 | 11/1996 | Vessari et al. . | |
| 5,699,707 | 12/1997 | Campbell, Jr. . | |
| 5,762,759 * | 6/1998 | Wedel | 162/193 |
| 5,794,500 | 8/1998 | Long et al. . | |
| 6,001,219 * | 12/1999 | Caspar | 162/286 |

FOREIGN PATENT DOCUMENTS

| | | |
|---|---|---|
| 0 250 651 | 1/1988 | (EP) . |
| 3222038 | 9/1988 | (JP) . |
| WO94/05473 | 3/1994 | (WO) . |

* cited by examiner

*Primary Examiner*—M. Rachuba
(74) *Attorney, Agent, or Firm*—Larson & Taylor, PLC

(57) ABSTRACT

A method for cutting off a longitudinal edge of a moving paper web utilizes a waterjet through the web to effect cutting. Air flow between the web and the web cutting top pull the web forward and towards the edge. Air flow from a pipe positioned upstream of the water jet presses the web against the cutting top.

6 Claims, 2 Drawing Sheets

METHOD AND APPARATUS FOR CUTTING THE EDGE OF A MOVING PAPER WEB

This application is a continuation-in-part application of U.S. Ser. No. 09/043,653, filed on Mar. 25, 1998, now abandoned.

FIELD OF THE INVENTION

The invention relates to edge cutting of a paper web using a water jet.

BACKGROUND OF THE INVENTION

Previously known from Finnish patent 12457 is edge cutting by a water jet. From the Finnish publications 83106 and 88417 diagonal cutting of a paper web is known, i.e. in the first place longitudinal cut off by means of a water jet.

The construction as per patent 12457 can be applied when the paper web speed is slow and cutting carried out close to the wet end. Then the forces generated by cutting hardly have an impact on the web forward travel. Instead, cutting of dry paper has turned out to be difficult by growing web speeds. Especially, on coating the paper, the edge arrives at cutting only after coating, where the uneven edge margin with the coating border is removed. After coating, due to cutting, the advancing web is equal in quality up to the edge. It has been established that a high-speed water jet produces in the edge of a fast moving web braking powers preventing the use of a water jet cutter. The web proceeds indeterminately and the possibility of breaks in the line grows.

SUMMARY OF THE INVENTION

With a method and an apparatus according to this invention the above introduced problem has been settled. In accordance with a preferred embodiment of the invention, in a method of longitudinally cutting an edge of a moving paper web comprises: supporting the web from at least one side in a cutting position on a cutting top; directing air flow from a pipe positioned above the cutting top downwardly onto the web in a direction of travel of the web to press the web against the cutting top; arranging diagonally located guides on the surface of the cutting top steering the web towards the edge of the web; and cutting the web by using a water jet positioned downstream of the pipe in the direction of travel of the web.

In another preferred embodiment of the invention an apparatus for removal of an edge of a moving paper web comprises a water jet nozzle for generating a water jet for cutting through the web, the nozzle being arranged at a selected cutting point; a cutting top for supporting the web at the cutting point; diagonally arranged guides on a cutting top for steering the web towards the edge of the web; and a pipe positioned above the cutting top and directed downwardly onto the web and toward the web for directing a flow of air onto the web to press the web against the cutting top, said pipe being positioned upstream of the nozzle in the direction of travel of the web.

Advantages of the present invention can be considered that it is possible to generate enough counterforces in the web edge in order to compensate the inconvenient forces on the web by the water jet. Cutting can be carried out in a dried and even in a coated paper web moving even faster than 20 m/s.

The cut edge can be easily after-treated, since, after cutting, the position of edge is stable on utilizing the method and apparatus as per this invention.

BRIEF DESCRIPTION OF THE DRAWINGS

The invention is disclosed with reference to the enclosed drawing, wherein.

DETAILED DESCRIPTION OF THE PREFERRED EMBODIMENTS

Figure 1:
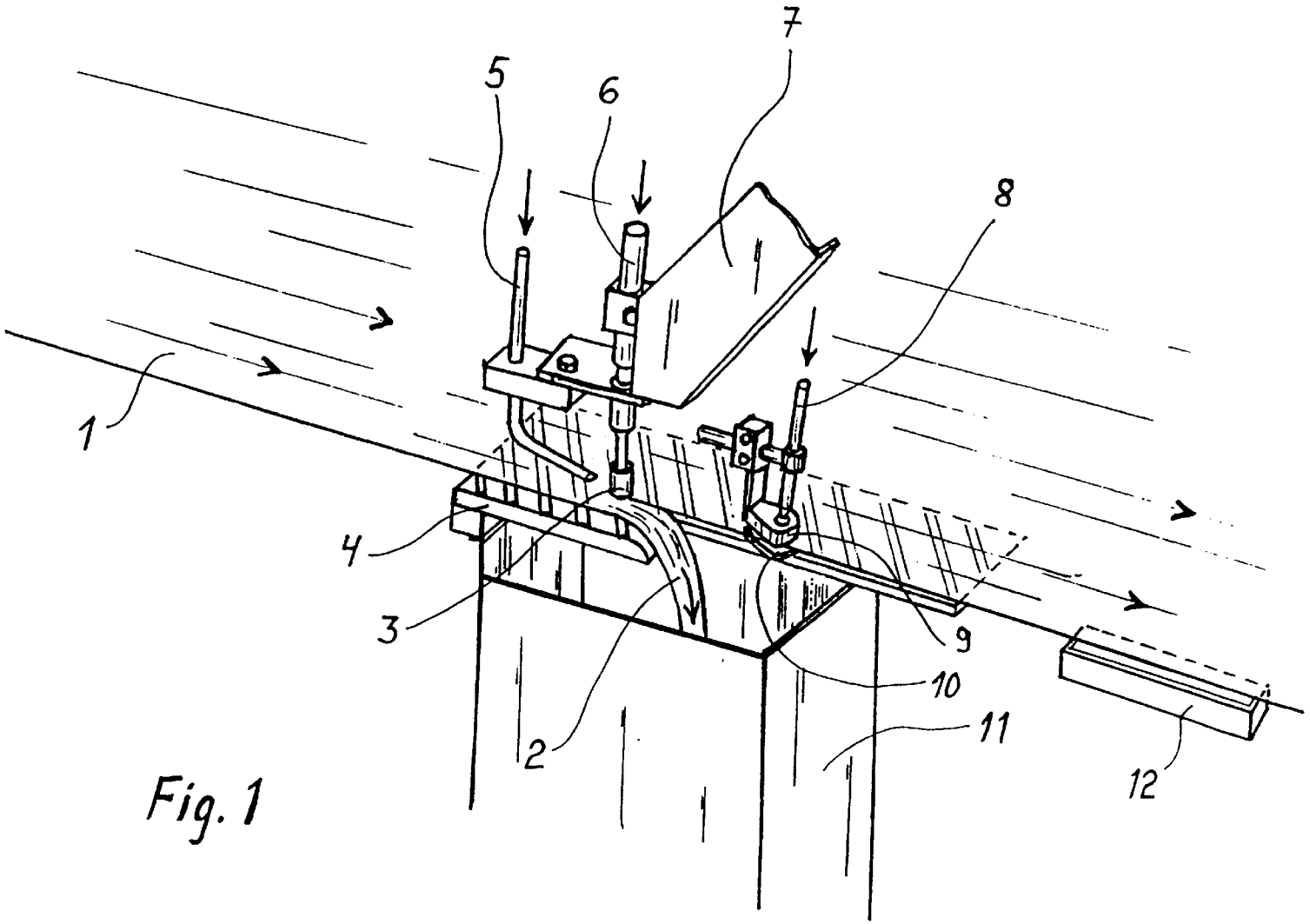
FIG. 1 is a diagonal view of the apparatus.

In FIG. 1 the paper web moves from the left to the right and a strip 2 is cut off from its edge. For cutting, a high-speed water jet is used, the nozzle portion 3 of which is very close, approximately at 1 mm distance from web 1. The cut off strip 2 is steered to a channel 11, into which an air flow to transport the edge strip is produced, which secures conveyance of the strip out from the channel. At the channel 11 mouth (not shown) is a control device with a photocell observing faulty motions of strip 2. For instance if a fault occurs where the strip is conveyed along with web 1 at a point where different functions occur, e.g. air blast, striving to steer strip 2 into channel 11, then nozzle 3 is finally pulled aside and the cutting of the edge strip is switched off. Conveyance of strip 2 along with web 1 causes an immediate line break possibility and efforts must be made to prevent such a possibility by means of safety devices.

Cutting water is conveyed to nozzle 3 along piping 6. The whole apparatus rests on a bearer 7 and the cutting line is adjusted moving the bearer sideways.

Along pipe 5 the air jet is guided to the cutting spot, where cutting dust and coating peeling off the paper and coating dust are conveyed to channel 11 and into the channel by suction. Typically air flow directed downwardly onto the paper web in the direction of travel of the web presses the paper web against the cutting top 4 before cutting. Air flow is from a pipe typically positioned above the cutting top 4 and can be directed downwardly onto the web in many ways. For example, pipe 5 may include holes in its lower surface so that the air can be better directed onto the web and towards greater area. Alternatively, two air flow pipes can be used, one for keeping the cutting area clean and one for directing air flow downwardly onto the support surface.

On the cutting line an after-treatment device is installed consisting of after-treatment pieces 9 and 10 installed on both sides of the web at the edge. In pieces 9, 10 there are sharp edges directed against the arriving web to sweep off portions that swell too much from the web surface. Further, about from the middle of these pieces air is blasted into the space between the pieces and the web in order to prevent full gliding contact. The direction of the air blast into the space between a piece and the web is turned mildly out off the web, whereby the blast residue goes to channel 11. Along pipe 8 compressed air is brought to the apparatus. The lower piece 10 is fixed to cutting top 4, the upper piece 9 is attached to the apparatus. The after-treatment equipment is resiliently attached to bearer 7 so that the apparatus is freely suspended by piece 9 above the web almost without any friction on an air cushion formed beneath piece 9. The web edge is dried by means of an infrared radiator 12, by means of which possible water jet moisture is lessened.

Figure 2:
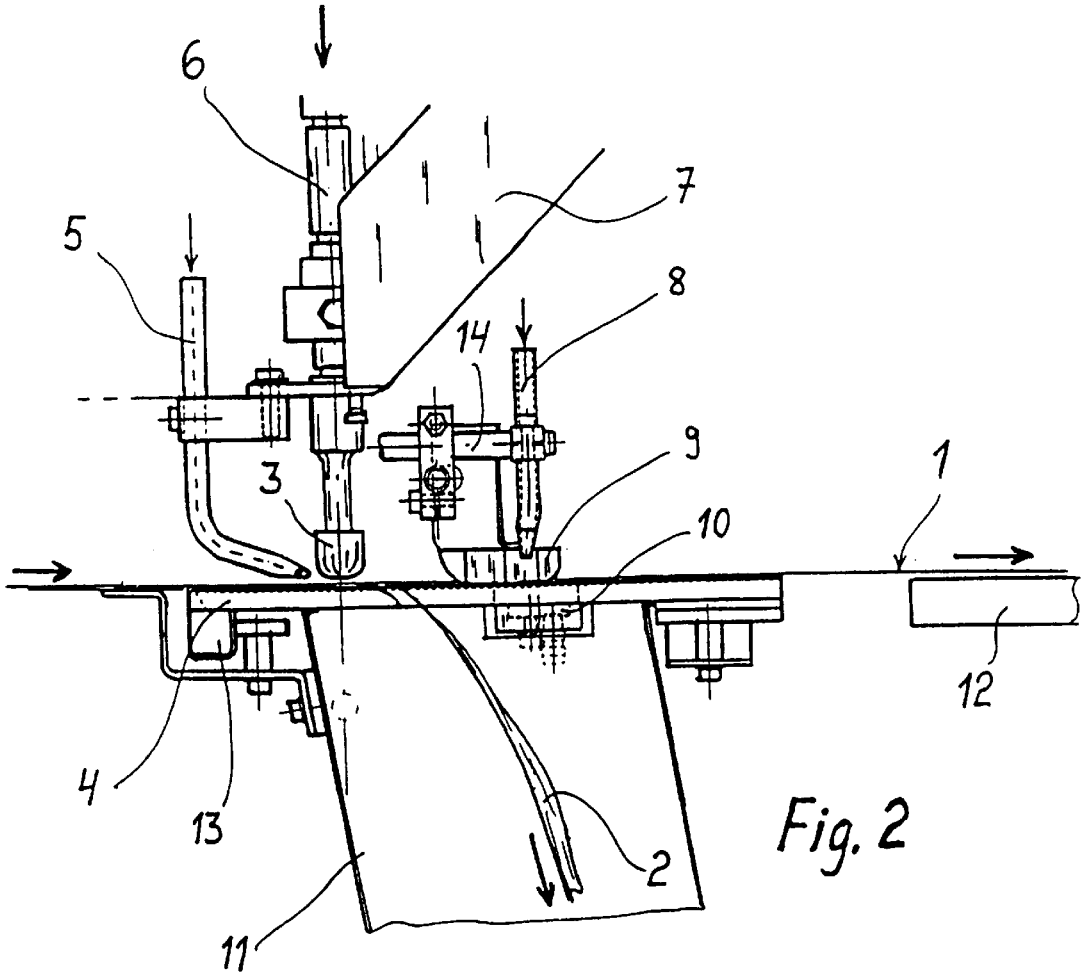
FIG. 2 is a side view of the apparatus.

FIG. 2 shows a side view of the complete apparatus with a sectional view of a part of channel 11. Web 1 travels above cutting top 4 almost touching this cutting top 4. Cutting and after-treatment take place above the channel 11 orifice.

Figure 3:
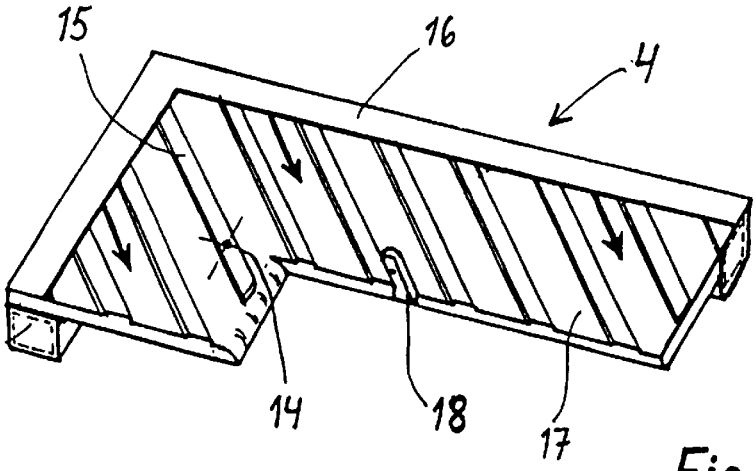
FIG. 3 is a cutting top.

FIG. 3 shows the cutting table, which is a top level 4 and most significant for the water jet cutting to work well, and most appropriately placed under the web at the cutting point. Water penetrating web 1 is conveyed out through a hole 14. The lower after-treatment piece 10 is placed in hole 18: On the cutting top underside surface there is a L-formed channel 13 into which compressed air is conveyed. From channel 13 compressed air has access to flow out from the underside of lathe 16 and along furrows 17 diagonally with respect to the web forward travel. The furrows 17 are separated from one another by ridges 15.

When compressed air in furrows 17 flows faster than the web and since it can be discharged into a larger space, i.e. to the outside, negative pressure is generated in the furrows pulling web 1 toward cutting top 4. The simultaneous direction sideways and forward chosen for the furrows produces forces of proper direction into the web compensating for the forces generated by the water jet, due to which the web travel would otherwise be disturbed. Additionally, holes may be arranged through the cutting top 4 in the furrows 17 or in the ridges 15.

The compensation forces formed by cutting top 4 are necessary for the web to endure continuous water jet cutting, without trouble, at usually applied speeds. The after-treatment equipment as per embodiments shown in FIGS. 1 and 2 is imperative for a reliable cutting operation and its necessity depends on the web quality. When cutting dried paper web this equipment is needed for dust and for cleaning the coating material and the web edge. Particles hovering in the air may not even begin to accumulate on the surface of the cutting equipment, since they could eventually contact the web and cause interruption in web travel. Dust and water mist must therefore be blasted or sucked off the cutting point if one wants to secure a reliable long-run function.

Cutting top 4 is shown from the web underside only, it can be located on both sides of the web. Most advantageously the cutting top is made of strong material or coated with such material. After-treatment devices 9, 10, 12 may be needed either on one side only or on both sides of the web.

I claim:

1. A method of longitudinally cutting an edge of a moving paper web comprising:

supporting the web from at least one side in a cutting position on a cutting top;

directing air flow from a pipe positioned above the cutting top downwardly onto the web in a direction of travel of the web to press the web against the cutting top;

arranging diagonally located guides on the surface of the cutting top steering the web towards the edge of the web; and cutting the web using a water jet positioned downstream of the pipe in the direction of travel of the web.

2. The method according to claim 1 further comprising the step of directing a forcible blast of air into a space between the web and the cutting top for generating forces to pull the web forward and toward the cutting edge for compensating against cutting forces.

3. The method according to claim 1 further comprising the step of blasting air in a discharge channel for receiving the edge after cutting to facilitate removal of the edge from the web, said blast of air being faster than travel speed of the edge.

4. An apparatus for removal of an edge of a moving paper web comprising:

a water jet nozzle for generating a water jet for cutting through the web, the nozzle being arranged at a selected cutting point;

a cutting top for supporting the web at the cutting point;

diagonally arranged guides on a cutting top for steering the web towards the edge of the web; and a pipe positioned above the cutting top and directed downwardly onto the web and toward the web for directing a flow of air onto the web to press the web against the cutting top, said pipe being positioned upstream of the nozzle in the direction of travel of the web.

5. The apparatus according to claim 4 further comprising:

a blast channel system for conveying air into a space between the cutting top and the web; and guides on a surface of the cutting top for steering a blast of air from the blast channel system in a direction of travel of the web diagonally towards the edge of the web to compensate for cutting forces.

6. The apparatus according to claim 5 further comprising a suction duct for removal of the edge after cutting.

* * * * *

UNITED STATES PATENT AND TRADEMARK OFFICE

CERTIFICATE OF CORRECTION

PATENT NO. : 6,327,948 B1
DATED : December 11, 2001
INVENTOR(S) : Tuori

It is certified that error appears in the above-identified patent and that said Letters Patent is hereby corrected as shown below:

Title page,
Please insert,
-- Item [63], Continuation-in-part of application No. 09/043,653, filed as application No. PCT/FI95/00523 on September 26, 1995, now abandoned. --

Column 1,
Delete lines 4-6, and insert therefore:
-- This application is a continuation-in-part of application of U.S. Ser. No. 09/043,653, filed as application No. PCT/FI95/00523 on September 26, 1995, now abandoned. --

Signed and Sealed this

Twenty-third Day of April, 2002

*Attest:*

*Attesting Officer*

JAMES E. ROGAN
*Director of the United States Patent and Trademark Office*